US010780478B2

(12) United States Patent
Wang et al.

(10) Patent No.: US 10,780,478 B2
(45) Date of Patent: Sep. 22, 2020

(54) METHOD OF FORMING A CUP SHAPED ALUMINUM MAGNESIUM ALLOY ARTICLE BY ROTARY EXTRUSION

(71) Applicant: NORTH UNIVERSITY OF CHINA, Shanxi (CN)

(72) Inventors: Qiang Wang, Shanxi (CN); Jianmin Yu, Shanxi (CN); Zhimin Zhang, Shanxi (CN); Xi Zhao, Shanxi (CN); Mo Meng, Shanxi (CN); Jian Xu, Shanxi (CN); Shaobo Cheng, Shanxi (CN)

(73) Assignee: NORTH UNIVERSITY OF CHINA, Taiyuan (CN)

( * ) Notice: Subject to any disclaimer, the term of this patent is extended or adjusted under 35 U.S.C. 154(b) by 196 days.

(21) Appl. No.: 15/955,757

(22) Filed: Apr. 18, 2018

(65) Prior Publication Data

US 2018/0369888 A1 Dec. 27, 2018

(30) Foreign Application Priority Data

Jun. 27, 2017 (CN) ..... 2017 1 0544772

(51) Int. Cl.
*B21C 23/14* (2006.01)
*B21C 25/02* (2006.01)
(Continued)

(52) U.S. Cl.
CPC ..... *B21C 23/14* (2013.01); *B21C 25/02* (2013.01); *B21C 25/08* (2013.01); *B21C 29/04* (2013.01); *B21C 23/212* (2013.01)

(58) Field of Classification Search
CPC ..... B21C 23/04; B21C 23/212; B21C 23/14; B21C 23/08; B21C 23/085; B21C 23/10;
(Continued)

(56) References Cited

U.S. PATENT DOCUMENTS 3,765,222 A * 10/1973 Lundback ..... B21C 23/10 72/467
3,808,860 A * 5/1974 Yamaguchi ..... B21C 23/085 72/60

(Continued)

*Primary Examiner* — Teresa M Ekiert
(74) *Attorney, Agent, or Firm* — Fleit Intellectual Property Law; Paul D. Bianco; Gary S. Winer

(57) ABSTRACT

Provided is a method of forming a cup-shaped aluminum-magnesium-alloy article by rotary extrusion, including the following steps. (1) Blanking. (2) Performing rotary extrusion: placing a cylindrical billet into a concave die cavity, wherein a peripheral wall of the cavity of the concave die is provided with at least two symmetrical axial grooves; inserting a convex die into the concave die cavity, wherein an end of a working region of the convex die is provided with a groove of a trapezoidal cross section; subjecting the convex die to forward extrusion and heating, and simultaneously rotating and heating the concave die, wherein an integral torque is formed during the extrusion process of the convex die by using the cylindrical billet inside the groove having a trapezoidal cross section, and wherein a synchronized rotation with the concave die is achieved by using a metallic billet that flows into the axial groove. (3) Demolding.

5 Claims, 8 Drawing Sheets

(51) Int. Cl.
*B21C 25/08* (2006.01)
*B21C 29/04* (2006.01)
*B21C 23/21* (2006.01)

(58) Field of Classification Search
CPC ..... B21C 23/005; B21C 23/008; B21C 25/02; B21C 25/04; B21C 25/08; B21C 29/04
USPC ..... 72/264
See application file for complete search history.

(56) References Cited

U.S. PATENT DOCUMENTS 4,462,234 A * 7/1984 Fiorentino ..... B21C 29/04 72/253.1
4,703,639 A * 11/1987 Fuchs, Jr. ..... B21C 23/32 72/254
7,225,658 B2 * 6/2007 Hakansson ..... B21C 1/24 72/267

* cited by examiner

METHOD OF FORMING A CUP SHAPED ALUMINUM MAGNESIUM ALLOY ARTICLE BY ROTARY EXTRUSION

CROSS REFERENCE TO RELATED APPLICATIONS

The application claims priority to Chinese Patent Application No. 201710544772.5 filed on Jun. 27, 2017 with the State Intellectual Property Office (SIPO) of the People's Republic of China, the contents of which are incorporated herein by reference in its entirety.

TECHNICAL FIELD

The present disclosure relates to the field of large plastic deformation of aluminum-magnesium alloy, in particular to a method of forming a cup-shaped aluminum-magnesium-alloy article through rotary extrusion.

BACKGROUND

Extrusion is a precise shape-forming method, which is highly recommended in plastic forming. Conventional extrusion refers to a press processing method, in which a punch is used to press a billet in a cavity of a concave die, such that a volume transfer in the material is resulted, so as to obtain a finished article corresponding to the shape of the mold cavity. During the extrusion, the billet is under three-directional compressive stress. Under such a condition, the material can fully exert its plasticity. Even for a billet having a relatively poor plasticity and not easy to process, it can also achieve a relatively good forming effect through extrusion. However, with regard to a material with a low plasticity, the finally formed workpiece would still have a relatively poor mechanical property even after undergoing the extrusion; and it is even made difficult to meet technical requirements due to inhomogeneous local deformation. The main causes for the inhomogeneous deformation generated during the extrusion are as follows: (1) there is a frictional force between the deformed metal and the mold; (2) the flow resistances to the metal in respective parts are inconsistent with each other; (3) the texture structure of the deformed metal is inhomogeneous, and (4) the shape and size of the working portion of the mold are unreasonable. These factors lead to a strong anisotropy in the extruded metal, which greatly limits the development of the extrusion forming process.

Now, a rotary extrusion forming technology is adopted. Such rotary extrusion forming technology is a novel extrusion method in which a torque is applied on the basis of the conventional extrusion. During the forming process, a convex die or a concave die is rotated, such that the stress-strain state in the interior of the deformed body is changed, generating a relatively great shear strain. This makes it possible to refine grains, form a fine-grain structure having a large angle grain boundary, ensure a uniform texture of the extruded member and reduce the anisotropy of the property of the formed member. Such a loading mode allows the formation of an axial compression in the deformed body on the one hand, and the torque may lead to the generation of a tangential shear strain and deformation on the other hand. Rotary extrusion is a composite loading deformation process, in which a contact friction can be effectively controlled and transformed towards a beneficial direction by applying a composite strong shear stress field on the deformed body, so as to achieve the objects of substantively changing the internal stress state of the material and improving the conventional press processing.

Summary of Disclosure

The present disclosure provides a method of forming a cup-shaped aluminum-magnesium-alloy article by rotary extrusion. This method remarkably reduces an axial extrusion force, makes the deformation of the article formed more uniform and improves the mechanical property of the workpiece.

In order to achieve the above-mentioned object, the following embodiments are employed in the present disclosure:

(1) blanking: providing a segment of cylindrical billet;

(2) performing rotary extrusion:

placing the cylindrical billet into a cavity of a concave die of a special mold, wherein the special mold is configured for rotary extrusion forming of the aluminum-magnesium-alloy article, wherein a peripheral wall of the cavity of the concave die is provided with at least two symmetrical axial grooves; wherein the interior of a clamping part of the concave die is made into a hollow cavity;

inserting a convex die of the special mold into the cavity of the concave die, wherein the special mold is configured for rotary extrusion forming of aluminum-magnesium-alloy article, wherein an end of a working region of the convex die is provided with a groove of a trapezoidal cross section, wherein the interior of the convex die is made into a hollow space with a constant cross-sectional area;

using a loading apparatus to perform forward extrusion on the convex die and heat the convex die, and simultaneously rotating and heating the concave die; wherein an integral torque is formed during extrusion of the convex die by using the cylindrical billet inside the groove of a trapezoidal cross section, and metallic materials from the billet, which flow into the axial grooves during the extrusion, are rotated synchronously with the concave die; and (3) demolding, taking out a cup-shaped light-weight alloy article from the cavity of the concave die after the rotary extrusion.

Further, in step (2), an electric heater for the concave die is placed in the cavity of the concave die.

Further, in step (2), the bottom of the cavity of the concave die that is configured for placement of the billet is made into in a form of an insert block, wherein the middle of the insert block is provided with a bore for welding a thermocouple wire, which is then placed together with the insert block at the bottom of the cavity of the concave die.

Further, in step (2), the symmetrical axial grooves provided in the peripheral wall of the cavity of the concave die are in a number of six.

Further, in step (2), an electric heater for the convex die is placed in the hollow space of the convex die.

In the present disclosure, a groove of a trapezoidal cross section is provided at an end of a working region of the convex die, such that a torque for the entire metal is formed during the extrusion process by using the metal in the groove of a trapezoidal cross section. Moreover, symmetrical axial grooves are provided on the peripheral wall of the cavity of the concave die, such that metallic materials from the billet, which flow into the axial grooves during the extrusion, are rotated synchronously with the concave die. The convex die and the concave die are heated at the same time, such that the heating for the extruded article intends to be uniform. In addition, an axial loading force on the billet is significantly reduced in the present disclosure through rotation of the concave die and a certain level of guiding effect of the axial groove for the flow of metallic billet in the axial groove. As a result, the shape-forming load and the tonnage of the device can be reduced, thereby achieving the object of "small device with a great capability".

DETAILED DESCRIPTION OF THE EMBODIMENTS

The present disclosure will be further described below by referring to the accompanying drawings and the embodiments.

Figure 1:
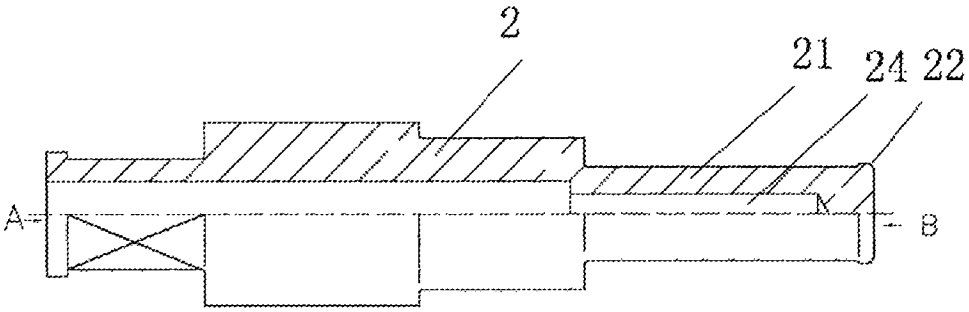
FIG. 1 is a sectional view of a convex die of the present disclosure.
Figure 2:
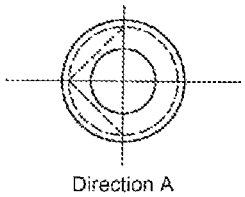
FIG. 2 is a view of the direction A in FIG. 1.
Figure 3:
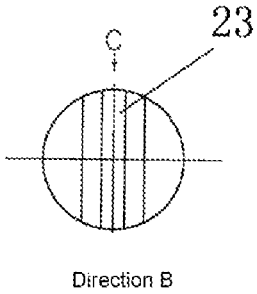
FIG. 3 is a view of the direction B in FIG. 1.
Figure 4:
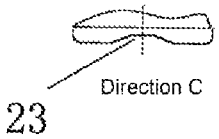
FIG. 4 is a view of the direction C in FIG. 3.
Figure 5:
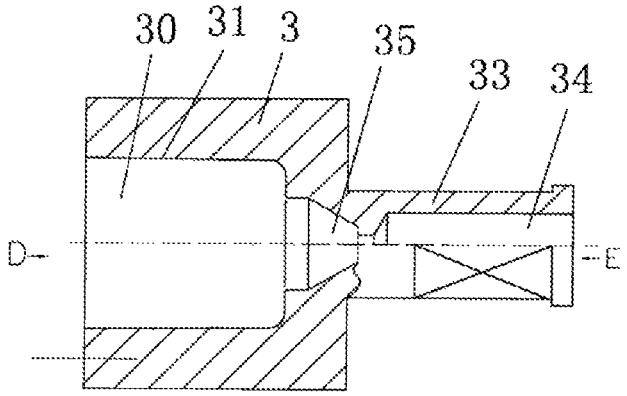
FIG. 5 is a sectional view of a concave die of the present disclosure.
Figure 6:
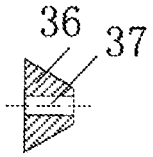
FIG. 6 is a sectional view of an insert block of the concave die of the present disclosure.
Figure 7:
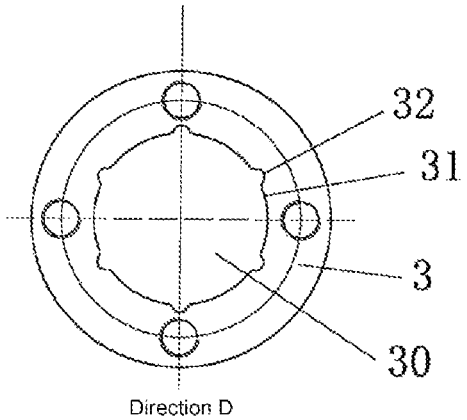
FIG. 7 is a view of the direction D in FIG. 5.
Figure 8:
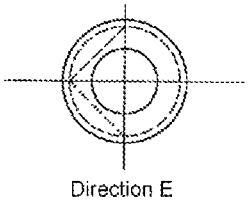
FIG. 8 is a view of the direction E in FIG. 5.
Figure 9:
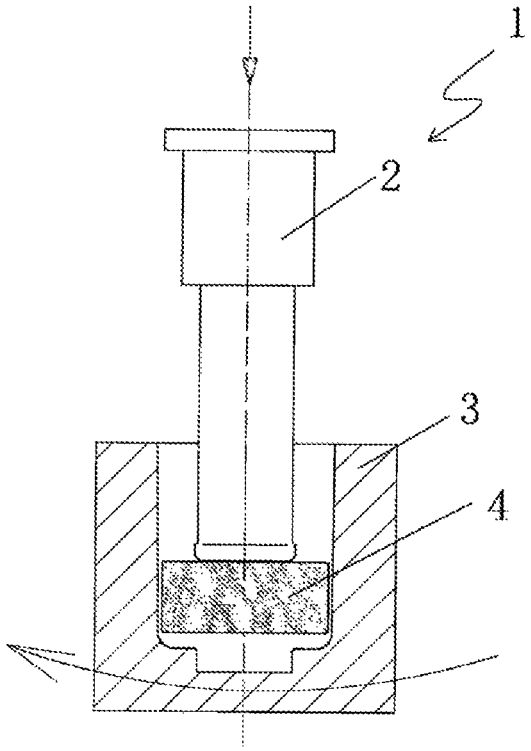
FIG. 9 is a schematic view I of a method of forming a cup-shaped aluminum-magnesium-alloy article by rotary extrusion according to the present disclosure.

As shown in FIGS. 1-8 and FIG. 9, provided is a special mold 1 for forming of an aluminum-magnesium alloy by rotary extrusion, including a convex die 2 and a concave die 3. An end 22 of a working region 21 of the convex die is provided with a groove of a trapezoidal cross section 23, so as to facilitate the formation of a torque for the entire metal during the shape-forming process by using the metal in the groove of a trapezoidal cross section 23. In order to ensure the heating efficiency of the billet and the service life of the convex die, the interior of the convex die 2 is made into a hollow space 24 with a constant cross-sectional area. The peripheral wall 31 of cavity 30 of the concave die is provided thereon with six symmetrical axial grooves 32. While the convex die 2 is extruding in forward direction, the billet and the concave die 3 undergo synchronized rotation by using the metal that flows into the axial groove 32 during the extrusion. In order to ensure a homogeneous heating of the billet, the interior of a clamping part 34 of the concave die is also made into a hollow cavity 33. In addition, in order to ensure the convenience for the welding of a thermocouple wire and to prevent it from falling off during the deformation, the bottom 35 of the cavity of the concave die 3, which is used for the placement of the billet, is made into a form of an insert block 36. The middle of the insert block 36 is provided therein with a bore 37 for welding a thermocouple wire (not shown in the figures). The bore is placed together with the insert block 36 into the bottom 35 of the cavity of the concave die 3, which facilitates the operations.

The special mold for forming an aluminum-magnesium alloy through rotary extrusion according to the present disclosure remarkably reduces an axial extrusion force, such that the deformation of the article formed thereof is more uniform. The mold can be applied to a twisting unit of Gleeble 3500 (a thermal simulation testing machine) for the shape-forming through the rotary extrusion. This lays a foundation for physical simulation of the rotary process parameters. In the twisting test, one end of the Gleeble 3500 specimen is prohibited from moving in the circumferential direction, and the other end is driven to rotate by a servo-controlled hydraulic device. As a result, the temperature gradient along the entire length of the scale distance of the twisted specimen is unevenly distributed in the axial direction, which would remarkably aggravate the degree of inhomogeneous strain. Through the sensing of a temperature measuring element, the system exerts dynamic program control over the loading and temperature of the twisted specimen. Therefore, through reasonable design of the structure and size of the special mold for rotary extrusion forming of an aluminum-magnesium-alloy article, and through effective control of temperature distribution, the heating for an internal specimen tends to become uniform, such that an efficient and uniform heating for the specimen is achieved, and a dynamic testing for shape-forming parameters of the twisting test is achieved.

If an electric heater for the convex die (not shown in the figures) is placed in the hollow space 24 of the convex die 2 and an electric heater for the concave die (not shown in the figures) is placed in the hollow cavity 33 of the concave die 3, the present disclosure may also be used in an ordinary extruder.

Figure 10:
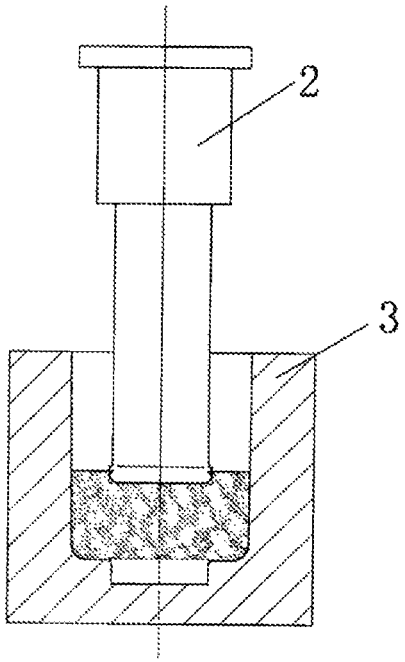
FIG. 10 is a schematic view II of the method of forming a cup-shaped aluminum-magnesium-alloy article by rotary extrusion according to the present disclosure.
Figure 11:
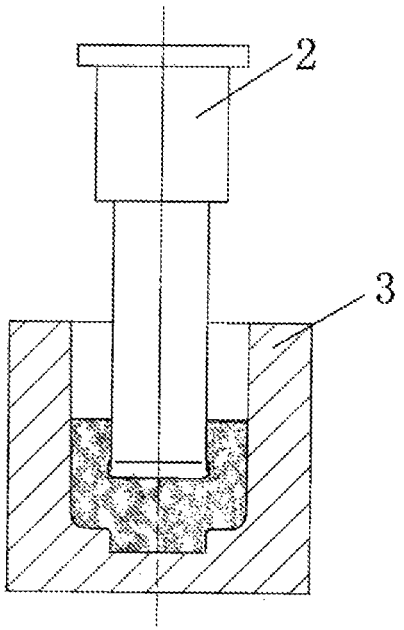
FIG. 11 is a schematic view III of the method of forming a cup-shaped aluminum-magnesium-alloy article by rotary extrusion according to the present disclosure.
Figure 12:
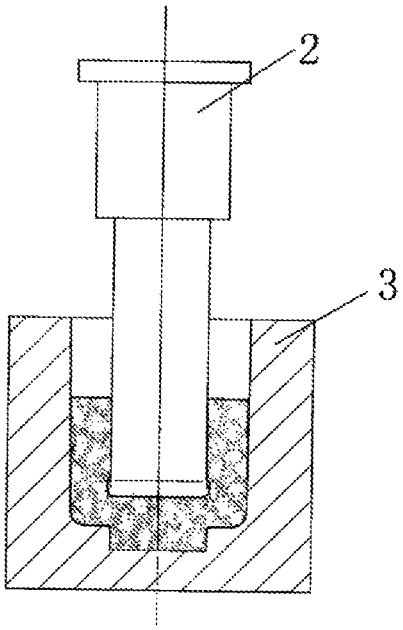
FIG. 12 is a schematic view IV of the method of forming a cup-shaped aluminum-magnesium-alloy article by rotary extrusion according to the present disclosure.
Figure 13:
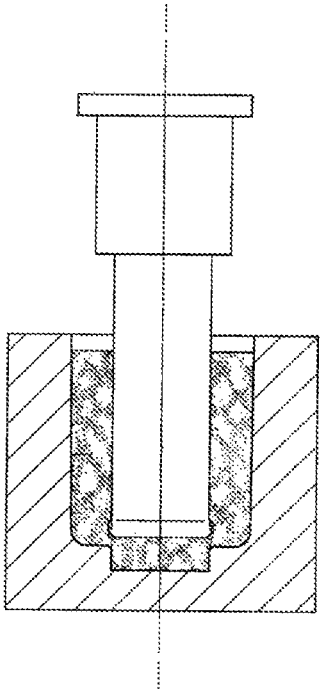
FIG. 13 is a schematic view V of the method of forming a cup-shaped aluminum-magnesium-alloy article by rotary extrusion according to the present disclosure.
Figure 14:
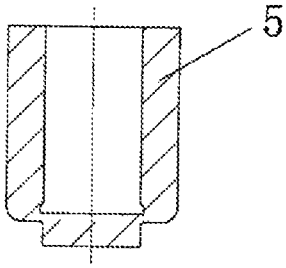
FIG. 14 is a sectional view of a cup-shaped aluminum-magnesium-alloy article according to the present disclosure.

As shown in FIGS. 9-14, FIG. 3, FIG. 4 and FIG. 7, a method for forming a cup-shaped aluminum-magnesium-alloy article by using the special mold 1 configured for forming an aluminum-magnesium-alloy article through rotary extrusion according to the present disclosure is as follows:

(1) blanking: wherein a cylindrical billet 4 is taken;

(2) performing rotary extrusion: wherein the cylindrical billet 4 is placed into a concave die cavity 30. A convex die 2 is inserted into the concave die cavity 30 for forward extrusion and heating, and at the same time the concave die 3 is rotated and heated, so as to achieve an effect of simultaneous rotation and extrusion. During the extrusion of the convex die 2, an integral torque is generated by using the cylindrical billet 4 inside the groove of a trapezoidal cross section 23. An axial extrusion force is significantly reduced by the rotation of the concave die 3, which promotes a uniform flow of the billet and improves the uniformity of the deformation. This significantly reduces the discrepancy between the axial and circumferential properties of the article formed and improves the shape-forming property. Moreover, this greatly reduces the frictional force, and improves the utilization of the material. Further, the metallic billet that flows into the axial groove 32 during the extrusion process is able to rotate synchronously with the concave die 3. The large plastic deformation process with simultaneous rotation and extrusion is beneficial to the improvement of the mechanical property of the workpiece formed thereof;

(3) demolding: a cup-shaped light-weight alloy article 5 is taken out from the concave die cavity 30 after the rotary extrusion.

Compared with the traditional direct extrusion, the method of shape-forming by rotary extrusion according to the present disclosure is associated with the following features. (1) After applying a twist action by the concave die, deformation and flow may also occur for materials at bottom and corners, the range of "blind spot" is remarkably reduced or even eliminated, which improves the utilization of the material. (2) After applying a torque to the concave die, the stress condition during the extrusion is changed. A strong shear deformation would have an important impact on the improvement of the microscopic texture. (3) In addition to flowing along a loaded axial direction, the extruded metal also has a tendency of being twisted and deformed along a circumferential direction. This, to a great extent, improves the degree of plastic deformation of the metal. (4) Under the same condition of extruding devices, the processing and manufacturing of an irregular cross section can be achieved; under the same condition of structures, the shape-forming load and the tonnage of the device can be reduced, thereby achieving the object of "small device with a big capability". By using these features of rotary extrusion in the present disclosure and by using the generation of tangential shear deformation, the normal pressure is decreased, the texture density is improved, the plastic deformation is increased, and the texture morphology of the material is improved. As a result, the deformation of the extruded article is more uniform. In another aspect, an axial extrusion force is significantly reduced, which makes the deformation of the article formed more uniform and greatly improves the mechanical property of the workpiece formed thereof. It improves the utilization of the material, and remarkable economic benefits can be achieved through promotion in the forging industry.

The invention claimed is:

1. A method of forming a cup-shaped aluminum-magnesium-alloy article, wherein the method comprises:

(1) providing a segment of a cylindrical billet; and (2) performing rotary extrusion by:

placing the cylindrical billet into a cavity of a concave die of a special mold, wherein the special mold is configured for performing the rotary extrusion to form the cup-shaped aluminum-magnesium-alloy article, a peripheral wall of the cavity of the concave die is provided with at least two symmetrical axial grooves, and a clamping part of the concave die is made to have a hollow cavity in an interior of the clamping part, inserting a convex die of the special mold into the cavity of the concave die, wherein an end of a working region of the convex die is provided with a groove of a trapezoidal cross section, and the convex die is made to have a hollow space in an interior of the convex die, with the hollow space having a constant cross-sectional area, and performing forward extrusion and heating on the convex die and simultaneously rotating and heating the concave die, wherein an integral torque is formed during the forward extrusion of the convex die, by using the cylindrical billet inside the groove of the trapezoidal cross section, and the cylindrical billet, which flows into the axial grooves during the extrusion, is rotated synchronously with the concave die; and (3) demolding, wherein the cup-shaped light-weight alloy article is taken out from the cavity of the concave die after the rotary extrusion.

2. The method according to claim 1, wherein the heating of the concave die is performed by an electric heater placed in the cavity of the concave die.

3. The method according to claim 1, wherein a bottom of the cavity of the concave die that is configured for placement of the billet is made into a form of an insert block, a middle of the insert block is provided with a bore for welding a thermocouple wire, and the thermocouple wire is placed together with the insert block at the bottom of the cavity of the concave die.

4. The method according to claim 1, wherein the at least two symmetrical axial grooves includes six symmetrical axial grooves.

5. The method according to claim 1, wherein the heating of the convex die is performed by an electric heater placed in the hollow space of the convex die.

* * * * *